US007936310B2

(12) United States Patent
Aiga et al.

(10) Patent No.: US 7,936,310 B2
(45) Date of Patent: May 3, 2011

(54) HIGH-IMPEDANCE SUBSTRATE

(75) Inventors: Fumihiko Aiga, Yokohama (JP); Seiichi Suenaga, Yokohama (JP); Kouichi Harada, Tokyo (JP); Tomohiro Suetsuna, Kawasaki (JP); Maki Yonetsu, Mitaka (JP); Naoyuki Nakagawa, Tokyo (JP); Tomoko Eguchi, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 466 days.

(21) Appl. No.: 12/175,854

(22) Filed: Jul. 18, 2008

(65) Prior Publication Data

US 2009/0021444 A1 Jan. 22, 2009

(30) Foreign Application Priority Data

Jul. 19, 2007 (JP) ..... 2007-188399

(51) Int. Cl.
*H01Q 1/38* (2006.01)
*H01Q 15/02* (2006.01)

(52) U.S. Cl. ..... 343/787; 343/909

(58) Field of Classification Search ..... 343/787, 343/846, 909

See application file for complete search history.

(56) References Cited

U.S. PATENT DOCUMENTS 6,483,480 B1 * 11/2002 Sievenpiper et al. ..... 343/909
6,538,621 B1 * 3/2003 Sievenpiper et al. ..... 343/909
6,774,866 B2 * 8/2004 McKinzie et al. ..... 343/909
7,411,565 B2 * 8/2008 McKinzie et al. ..... 343/909

FOREIGN PATENT DOCUMENTS

JP 2005-538629 12/2005

OTHER PUBLICATIONS

U.S. Appl. No. 11/746,240, filed May 2007, Aiga et al.
Sievenpiper, et al., "*High-Impedance Electromagnetic Surfaces with a Forbidden Frequency Band*", IEEE Transactions On Microwave Theory And Techniques, vol. 47, No. 11, Nov. 1999.

* cited by examiner

*Primary Examiner* — Michael C Wimer
(74) *Attorney, Agent, or Firm* — Ohlandt, Greeley, Ruggiero & Perle, L.L.P.

(57) ABSTRACT

A high-impedance substrate is provided, which includes a metallic plate employed as a ground plane, a resonance circuit layer spaced away from the metallic plate by a distance "t", the resonance circuit layer being provided with at least two resonance circuits having the same height and disposed side by side with a distance "g", a connecting component connecting the resonance circuit with the metallic plate, and a magnetic material layer interposed between the metallic plate and the resonance circuit layer. The distance "t" between the metallic plate and the resonance circuit layer is confined within the range of 0.1 to 10 mm, the distance "g" between neighboring resonance circuits is confined within the range of 0.01 to 5 mm, the distance "h" between the magnetic material layer and the resonance circuit layer is confined within the range represented by the following inequality 1:

$g/2 \leq h \leq t/2$ inequality 1.

20 Claims, 4 Drawing Sheets

HIGH-IMPEDANCE SUBSTRATE

CROSS-REFERENCE TO RELATED APPLICATIONS

This application is based upon and claims the benefit of priority from prior Japanese Patent Application No. 2007-188399, filed Jul. 19, 2007, the entire contents of which are incorporated herein by reference.

BACKGROUND OF THE INVENTION

1. Field of the Invention

This invention relates to a high-impedance substrate that employs an artificial medium.

2. Description of the Related Art

With a view to reducing the electric power of the antenna for handling the radio wave of a high-frequency region, there have been proposed various methods. For example, there has been proposed a method wherein a unit particle made of a metal and having a size which is almost the same as or smaller than the wavelength of an electromagnetic wave to be employed is used and, at the same time, the manner of arranging the unit particle is devised. Using this method, it has been made possible to realize an artificial medium having characteristics which differ from the physical properties which the material inherently has and to apply the artificial medium to a left-handed system medium, a resonator and artificial dielectric.

Further, there has been proposed a technique to enhance the characteristics of an antenna through the utilization of the phenomenon that an artificial medium having resonators arranged periodically is capable of acting, while achieving high-impedance, at a frequency in the vicinity of a band gap. This technique, however, is accompanied with the problem that when the capacitance "C" is increased, the normalized bandwidth becomes smaller.

On the other hand, there is an advantage that when the inductance "L" is increased, the normalized bandwidth can be made larger and it is possible to lower the frequency of the radio wave. Although there is known a method of increasing the thickness of the antenna for the purpose of increasing the inductance "L", this may conflict with the demand to realize a thinner substrate. Under the circumstances, it is desired to increase the inductance "L" through the increase of magnetic permeability "μ" with a magnetic material.

For example, JP-A 2005-538629 (KOHYO) discloses a high-impedance substrate having a mushroom structure using ferrite as a magnetic material. The magnetic materials employed in this publication are, in most cases, not only large in magnetic permeability but also large in dielectric constant, thus resulting in an increase of the capacitance "C". As a result, the normalized bandwidth becomes smaller. Namely, up to the present, no one has succeeded to obtain a thin high-impedance substrate having a large normalized bandwidth at a low frequency band.

BRIEF SUMMARY OF THE INVENTION

A high-impedance substrate according to one aspect of the present invention comprises:

a metallic plate to be employed as a ground plane;

a resonance circuit layer spaced away from the metallic plate by a distance "t" ranging from 0.1 to 10 mm, the resonance circuit layer being provided with at least two resonance circuits having the same height and disposed side by side with a distance "g" ranging from 0.01 to 5 mm;

a connecting component connecting the resonance circuit with the metallic plate; and a magnetic material layer interposed between the metallic plate and the resonance circuit layer and spaced away from the resonance circuit layer by a distance "h" confined within the range represented by the following inequality:

$$g/2 \leqq h \leqq t/2 \qquad \text{inequality 1.}$$

A high-impedance substrate according to another aspect of the present invention comprises:

a metallic plate to be employed as a ground plane;

a resonance circuit layer spaced away from the metallic plate by a distance "t" ranging from 0.1 to 10 mm, the resonance circuit layer being provided with at least two resonance circuits disposed side by side with a distance "g" ranging from 0.01 to 5 mm;

a connecting component connecting the resonance circuit with the metallic plate; and a magnetic material layer formed of a nano-composite material containing magnetic particles and an insulating material and interposed between the metallic plate and the resonance circuit layer and spaced away from the resonance circuit layer by a distance "h" confined within the range represented by the following inequality:

$$g/2 \leqq h \leqq t/2 \qquad \text{inequality 1.}$$

A high-impedance substrate according to a further aspect of the present invention comprises:

a metallic plate to be employed as a ground plane;

a resonance circuit layer spaced away from the metallic plate by a distance "t" ranging from 0.1 to 10 mm, the resonance circuit layer being provided with at least two resonance circuits having the same height and disposed side by side with a distance "g" ranging from 0.01 to 5 mm; and a magnetic material layer formed of a nano-composite material containing magnetic particles and an insulating material and interposed between the metallic plate and the resonance circuit layer and spaced away from the resonance circuit layer by a distance "h" confined within the range represented by the following inequality:

$$g/2 \leqq h \leqq t/2 \qquad \text{inequality 1.}$$

DETAILED DESCRIPTION OF THE INVENTION

Next, embodiments will be explained with reference to the drawings.

Figure 1:
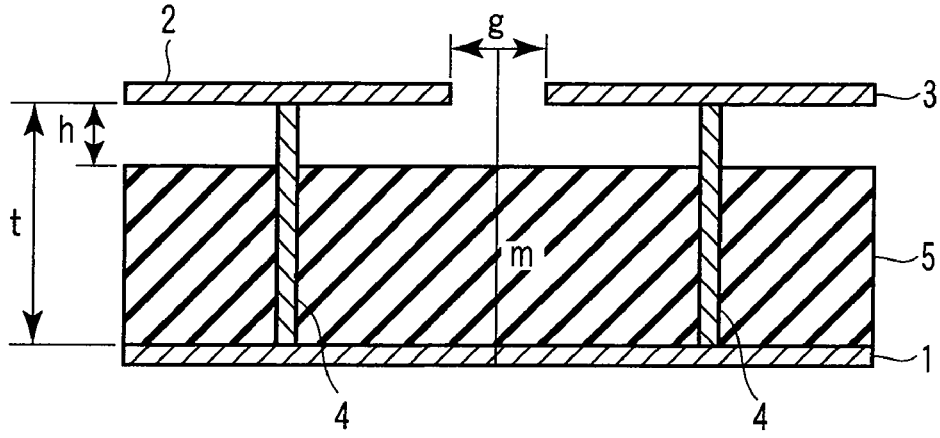
FIG. 1 is an enlarged cross-sectional view schematically illustrating the high-impedance substrate according to one embodiment.

As shown in FIG. 1, in the high-impedance substrate one embodiment, a metallic plate 1 to be employed as a ground plane is connected, via a connecting component 4, with resonance circuits 2 and 3. Using at least two resonance circuits, 2 and 3, a resonance circuit layer is constituted. These resonance circuits 2 and 3 are disposed at the same level. Even if three or more resonance circuits are present, they are all disposed at the same level. The shortest distance between the metallic plate 1 and the resonance circuit layer is represented herein as "t", which is confined within the range of 0.1-10 mm. Further, the shortest distance between neighboring resonance circuits is represented herein as "g" which is confined within the range of 0.01-5 mm. In this embodiment, the processing accuracy and the capacitance between resonators are taken into consideration on the assumption that the high-impedance substrate is mounted on a mobile telephone or a thin electronic device such as a personal computer, so that the aforementioned shortest distances "t" and "g" are regulated within the aforementioned ranges.

Further, a magnetic material layer 5 is interposed between the metallic plate 1 and the resonance circuit layer, and the shortest distance between the magnetic material layer 5 and the resonance circuit layer is represented herein as "h".

In the high-impedance substrate according to the embodiments, the shortest distance "h" between the magnetic material layer 5 and the resonance circuit layer is regulated within the range represented by the following inequality 1:

$$g/2 \leqq h \leqq t/2 \qquad \text{inequality 1.}$$

Figure 2:
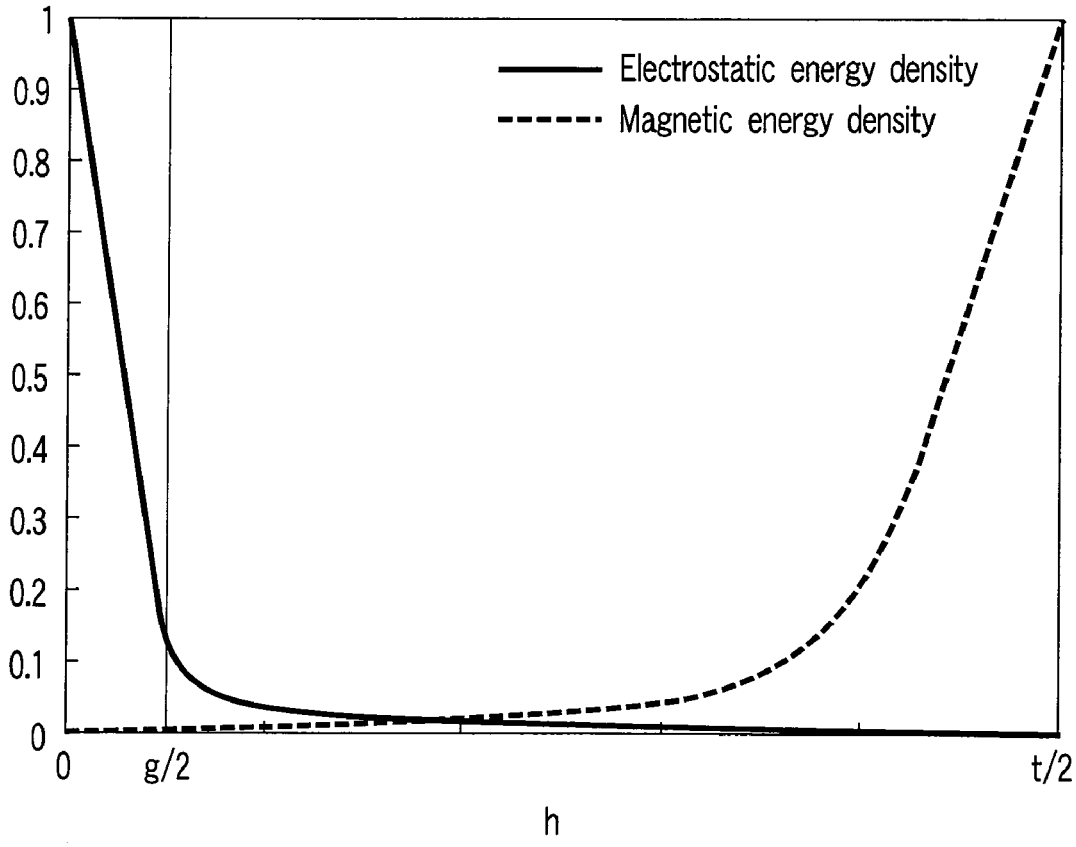
FIG. 2 is a graph illustrating electrostatic energy density and magnetic energy density.

With a view to satisfactorily securing not only the electrostatic energy density but also the magnetic energy density, the present inventors have discovered the following facts. They will be explained with reference to FIG. 2. In FIG. 2, the abscissa represents the shortest distance "h" between the magnetic material layer and the resonance circuit layer, wherein the range thereof is indicated using the value of "g" and the value of "t" described above. In this case, the electrostatic energy density and the magnetic energy density are based on the values measured on the straight line "m", i.e. the symmetry line with respect to the resonance circuits 2 and 3 of the high-impedance substrate shown in FIG. 1, these values being respectively indicated as a ratio relative to the maximum value.

In terms of magnetic energy, the volume of the magnetic material layer should preferably be as large as possible. Meanwhile, the magnetic energy density becomes maximum at h=t/2 and decays sharply as the distance "h" decreases. On the other hand, although the electrostatic energy density becomes maximum at h=0, it decays sharply as the distance "h" increases, and when h=g/2, the electrostatic energy density decreases to about 1/10.

Based on the above facts, the optimum range of "h" was found, which makes it possible to prevent the increase of capacitance "C" while realizing a desired inductance "L". Namely, this optimum range is the one that can be represented by the aforementioned inequality. The magnetic material layer 5 is disposed on the metallic plate 1 side with a thickness of at least a half (t/2) of the space between the metallic plate 1 and the resonance circuit layer which are spaced apart by a distance of "t". The upper limit (t/2) of the shortest distance "h" between the magnetic material layer 5 and the resonance circuit layer has been determined in this manner. As shown in FIG. 2, in order to secure an acceptable magnitude of electrostatic energy, the lower limit of the shortest distance "h" between the magnetic material layer 5 and the resonance circuit layer has been set to g/2.

Figure 3:
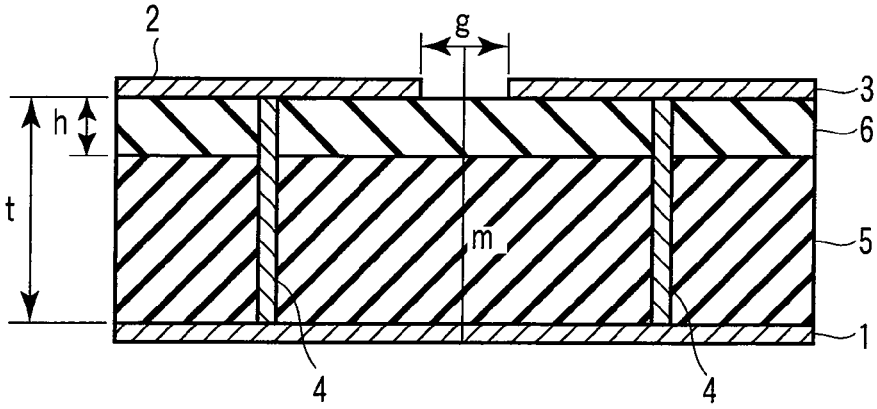
FIG. 3 is an enlarged cross-sectional view schematically illustrating the high-impedance substrate according to another embodiment.

For the structure shown in FIG. 1, although a layer of air exists between the magnetic material layer 5 and the resonance circuit layer, the embodiment should not be construed as being limited to this structure. It is possible to interpose a dielectric layer 6 which is small in dielectric constant between the magnetic material layer 5 and the resonance circuit layer as shown in FIG. 3. As the dielectric layer 6 which is small in dielectric constant, it is possible to employ oxides such, for example, as Mg oxide, Al oxide and Si oxide.

By suitably selecting the configuration of each resonance circuit, the manner of arrangement of resonance circuits, and the dielectric constant and magnetic permeability of magnetic material, it is possible to obtain a desired operation frequency. Further, if the dielectric constant, magnetic permeability and surface resistance of magnetic materials are known, the high-frequency characteristics of a high-impedance substrate can be estimated through the electromagnetic field simulation thereof.

The metallic plate 1 and the resonance circuits 2 and 3 can be constituted using a metal which is small in conductive loss, such as copper. Alternatively, it is also possible to employ superconductive materials other than metals.

Figure 4:
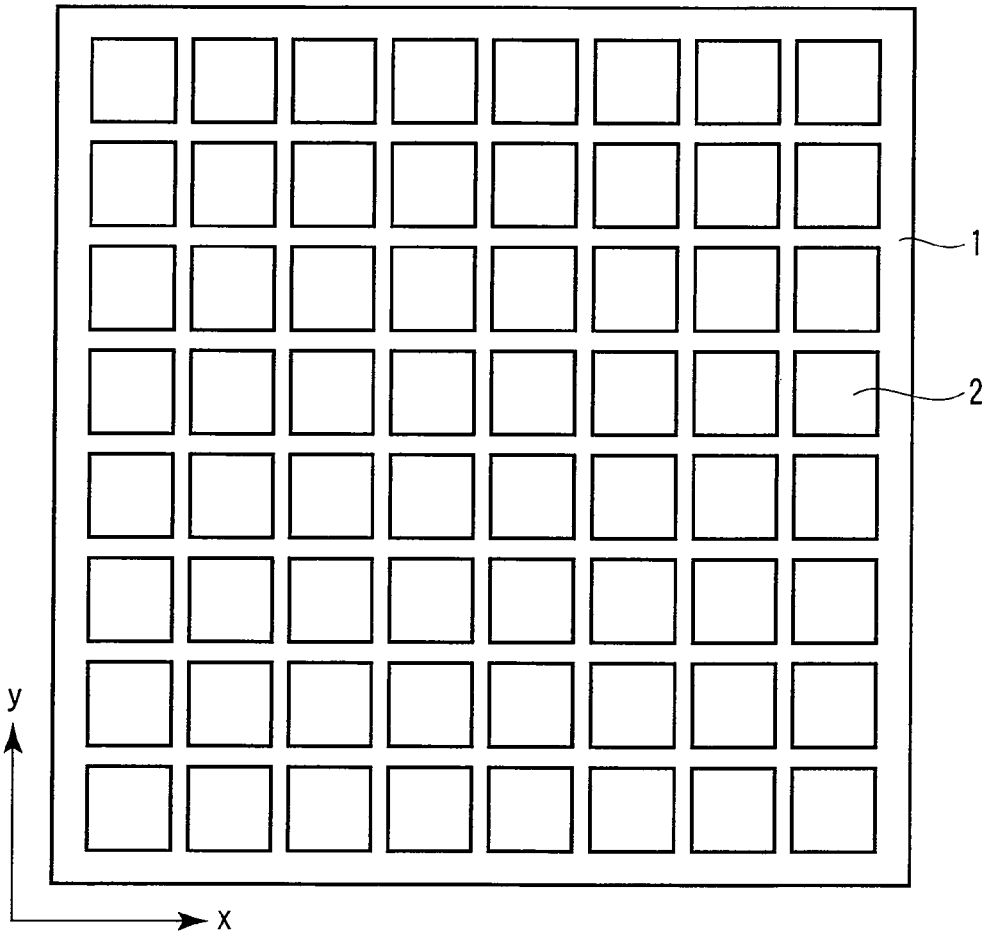
FIG. 4 is a top plan view schematically illustrating the high-impedance substrate according to one embodiment.
Figure 5:
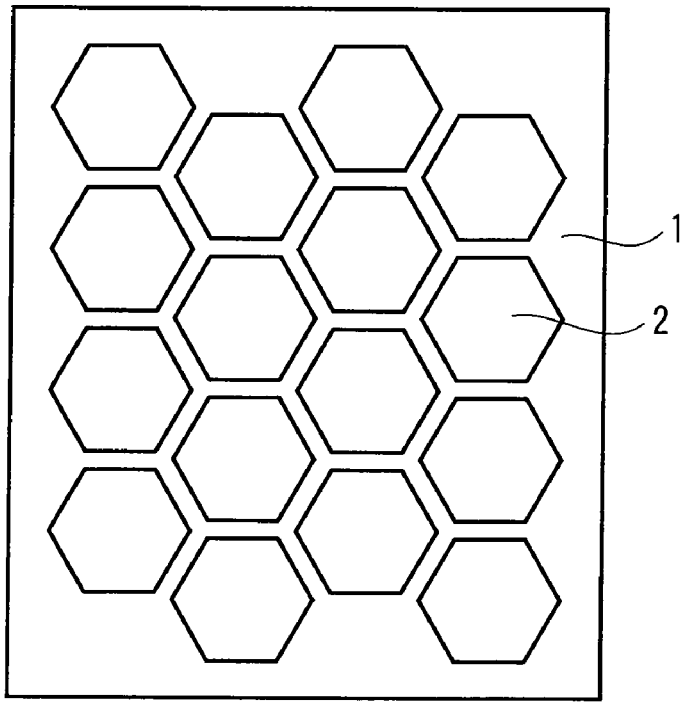
FIG. 5 is a top plan view schematically illustrating the high-impedance substrate according to another embodiment.

The resonance circuits 2 and 3 may be configured to have a square top surface, for example, as shown in FIG. 4. However, the configuration of the resonance circuits 2 and 3 may be variously modified to take any desired configuration, as long as they can be connected with the metallic plate 1 and they can be electrostatically connected with each other. For example, the top surface of these resonance circuits 2 and 3 may be configured to have a regular hexagonal top surface, as shown in FIG. 5.

Each of these resonance circuits 2 and 3 need not necessarily be arranged periodically. Namely, the number of resonance circuit layer may be optionally changed in an x-direction or y-direction. It is possible, theoretically, to realize a band structure by periodically arranging an infinite number of resonance circuits. When this fact is taken into account, it may be preferable to periodically arrange a large number of resonance circuits. However, as long as at least two resonance circuits are arranged in one direction, it is possible to actuate the device.

The magnetic material layer 5 should preferably be formed of a nano-composite material where magnetic particles are dispersed in an insulating material. When this nano-composite material is fabricated integrally with a metallic resonance circuit and employed in an electronic device, it is possible to prevent the propagation of cracks even if the metal is expanded/contracted due to the temperature change thereof, which ranges from room temperature to about 100° C. For this reason, it is possible to retain desired high-frequency characteristics of the device. This phenomenon was discovered by the present inventors. The nano-composite material for forming the magnetic material layer 5 need not be required to be fabricated as an integral body, and may be fabricated through the integration of small pieces or thin films thereof.

Figure 6:
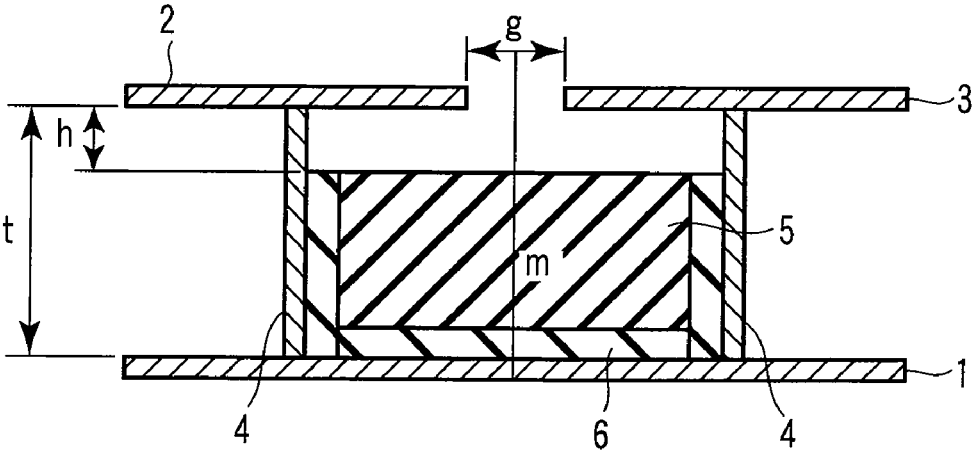
FIG. 6 is an enlarged cross-sectional view schematically illustrating the high-impedance substrate according to a further embodiment.
Figure 7:
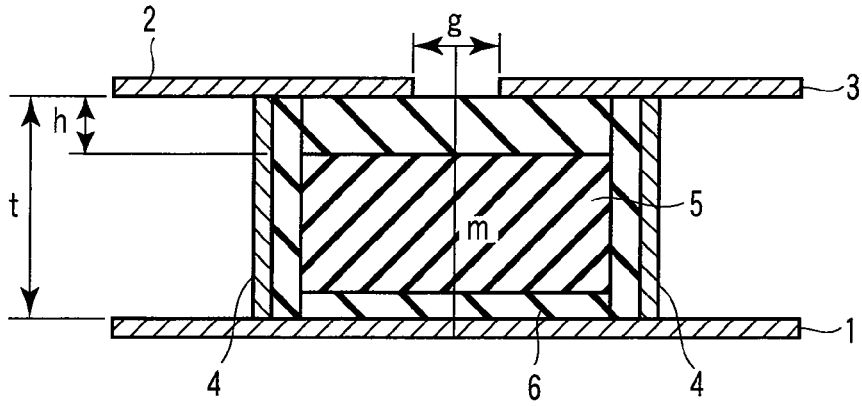
FIG. 7 is an enlarged cross-sectional view schematically illustrating the high-impedance substrate according to a further embodiment.

In order to prevent the magnetic particles in the magnetic material layer 5 from directly contacting the resonance circuit, a dielectric layer 6 may be interposed between the magnetic material layer 5 and the connecting component 4, as shown in FIG. 6. Further, as shown in FIG. 7, the dielectric layer 6 may be interposed also between the magnetic material layer 5 and the resonance circuits 2 and 3. When the dielectric layer 6 is interposed also between the metallic plate 1 and the magnetic material layer 5 as shown in FIGS. 6 and 7, it is possible to enhance the insulation between the magnetic material layer 5 and the metallic plate 1, thereby making it possible to realize stabilized high-impedance characteristics.

As the magnetic materials for constituting the nano-composite material, it is possible to employ at least one kind of particles selected from the group consisting of Fe particles, Co particles, Fe—Co alloy particles, Fe—Co—Ni alloy particles, Fe-based alloy particles and Co-based alloy particles. Preferably, the Fe-based alloy particles should partially contain Co or Ni in viewpoint of enhancing the oxidation resistance thereof. Especially, the employment of Fe—Co-based particles is preferable in viewpoint of saturation magnetization.

The magnetic materials may be formed of an alloy comprising at least one magnetic metal selected from Fe, Ni and Co, and a non-magnetic metallic element which is alloyed with the magnetic metal. However, if the quantity of the non-magnetic metallic element in the alloy is excessively large, the saturation magnetization may be excessively lowered. Therefore, the content of the non-magnetic metallic element should preferably be confined to not more than 10 atom. %. One specific example of such magnetic alloy particles is amorphous Fe—Co—B magnetic alloy particles.

Incidentally, the non-magnetic metal may be singly dispersed in a composite material. In this case, the content of the non-magnetic metal should preferably be confined to not more than 20% by volume.

The particle diameter of the magnetic particle should preferably be confined to the range of 1-1000 nm, more preferably 1-100 nm. Magnetic particles having a particle diameter of not more than 100 nm is effective in reducing as much as possible any possibility of generating eddy current loss when the magnetic particles are to be employed in electronic communication equipment. Incidentally, when the particle diameter of the magnetic particle is larger than 100 nm, the high-frequency characteristics of magnetic permeability of multi-magnetic domain structure tend to become lower than the high-frequency characteristics of the magnetic permeability of a single magnetic domain structure. Therefore, for the composite material to be employed in the base material medium of this embodiment, the magnetic metal particles (or magnetic alloy particles) should preferably exist as single magnetic domain particles.

Since the upper limit of the particle diameter of magnetic particles that makes it possible to stably retain the single magnetic domain structure is around 50 nm, the particle diameter of magnetic particles should preferably be confined to not larger than 50 nm. On the other hand, if the particle diameter of magnetic particles is less than 1 nm, superparamagnetism may generate, thus possibly lowering the saturation magnetic flux density. In view of these facts, the particle diameter of magnetic particles should more preferably be confined to the range of 1-100 nm, most preferably the range of 10-50 nm.

As the insulating material, it is possible to employ at least one selected from the group consisting of oxides, nitrides, carbides and fluorides of at least one metallic element selected from the group consisting of Mg, Al, Si, Ca, Cr, Ti, Zr, Ba, Sr, Zn, Mn, Hf and rare earth elements. Among them, the employment of oxides of the aforementioned metallic elements is preferable. Especially, oxides of Mg, Al and Si are more preferable. Among them, Si oxides are most preferable.

Alternatively, it is possible to employ insulating resins such as polyvinyl alcohol (PVB), polybutadiene, polystyrene, polyethylene, polyethylene terephthalate, polypropylene, epoxy resin, etc. The insulation resistance of the insulating resins should preferably be not less than $1\times10^2$ μΩ·cm, more preferably not less than $1\times10^9$ μΩ·cm. Further, the dielectric loss of the insulating resins should preferably be as small as possible.

The state of dispersion of the magnetic particles in the insulating material as they are used in the combination of the magnetic particles with the resonance circuits is important in viewpoint of enhancing the characteristics (especially, magnetic permeability) of the high-frequency magnetic material.

A plurality of magnetic particles should desirably be present in the insulating material in a magnetically independent manner. Namely, it is desirable that the magnetic particles be present in the insulating material in a magnetically isotropical manner. So long as the distance between magnetic particles is sufficient to permit the magnetic particles to exist magnetically independently, there is no particular limitation with regard to the distance between magnetic particles. For example, the intervals between the magnetic particles in the insulating material should preferably be confined within the range of 1-100 nm or more, more preferably 5-20 nm or more.

On the other hand, the volume percentage of the magnetic particles occupying the composite material constituting a matrix medium should preferably be as large as possible under the condition that the magnetic bond among the magnetic particles can be broken. The reason for this is that, if so, it is possible to secure increased magnetization per volume. It has been found out by the present inventors that the volume percentage of the magnetic particles occupying the composite material should preferably be confined to the range of 10-30%.

As described above, by dispersing the magnetic particles in the insulating material, it is possible to obtain a composite material having an electric resistance of as large as 1 Ω·cm or more. As a result, it is possible to secure an increased resonance frequency of the high-frequency magnetic material. This resonance frequency can be controlled by suitably adjusting the configuration, particle diameter and particle-particle distance of magnetic particles. For example, when magnetic particles formed of a material such as Fe, Co, FeCo, etc. are employed, the resonance frequency can be confined within the range of 1-20 GHz.

The magnetic particles may be anisotropic in shape, such as columnar. In this case, the columnar magnetic particles should preferably be insulated from each other by an insulating material layer. Further, in the case of magnetic particles having a columnar structure, the axis of easy magnetization of the magnetic metal crystal constituting a columnar crystal should preferably be orientated in the longitudinal direction of the columnar crystal.

In the case where the magnetic particles are magnetically bonded with each other in the magnetic particles having a columnar structure, the magnetic particles should preferably be provided with magnetic anisotropy (uniaxial anisotropy) in one direction within the plane of the composite material where the bonding direction of the columnar structure is orthogonally intersected. In the case of a composite material having such a structure, it is possible to enhance the real part of magnetic permeability.

As the magnitude of uniaxial anisotropy of the composite material, it should preferably be not less than 100 Oe, or more preferably not less than 200 Oe in the value of Ha (anisotropic magnetic field).

Especially, when it is desired to employ a composite material having in-plane anisotropy, it is preferable for the composite material to be disposed such that the direction of anisotropy intersects orthogonally with the magnetic field.

The nano-composite material containing the aforementioned magnetic particles and the aforementioned insulating material can be manufactured by the following method. First of all, an aqueous acid solution containing the raw material of magnetic particles and the raw material of an insulating material is prepared. As the raw material of magnetic particles, it is possible to employ an aqueous solution of nitrate of magnetic metal elements such as, for example, iron nitrate, cobalt nitrate, etc. As the raw material of insulating material, it is possible to employ an aqueous solution of nitrate of insulating oxide-forming metal elements such as, for example, magnesium nitrate, etc. The raw material of magnetic particles and the raw material of insulating material are then mixed together in such a manner that the molar ratio between the metal element constituting the magnetic particles and the metal element constituting the insulating material is confined within the range of 1:9-9:1.

Meanwhile, an aqueous alkaline solution is prepared and added drop-wise to the aforementioned aqueous acid solution. As the aqueous alkaline solution, it is possible to employ, for example, an aqueous solution of tetramethyl ammonium hydroxide (TMAH) having a concentration of about 1-20% by volume.

Then, this aqueous acid solution is added dropwise to the aqueous alkaline solution, thereby causing a composite hydroxide salt consisting of the magnetic metal element and the insulating oxide-forming metal element to create and precipitate. Then, this composite hydroxide salt is pre-baked to obtain a powdery precursor. This powdery precursor thus obtained is then subjected to reduction sintering in a reducing atmosphere (atmosphere of hydrogen, carbon monoxide, etc.) at a temperature ranging from 100° C. to 800° C., thereby manufacturing the nano-composite material where the nanoparticles of magnetic metal are dispersed in the insulating oxide.

Using the nano-composite material thus obtained, a magnetic material layer is formed to manufacture a high-impedance substrate as shown in FIG. 1. In this case, the manufacture of a high-impedance substrate can be performed according to the following method. First of all, a copper foil to be utilized as a ground plane (metallic plate) 4 is disposed on the underside of the magnetic material layer 5 and then a resist layer is formed on the magnetic material layer 5. Then, a pattern for forming vias is formed on the resist layer by photolithography and subjected to laser etching or dry etching to form through-holes for the vias in the magnetic material layer 5.

Thereafter, by electrolytic plating or nonlectrolytic plating, a copper foil is formed all over the top surface of the magnetic material layer 5 including the through-hole portions thereof. Then, the copper foil on the top surface is selectively removed to form a resist layer and, by photolithography, a pattern corresponding to the gap "g" is formed. Finally, the resist layer is removed by a resist-removing material, thus forming a high-impedance substrate as shown in FIG. 1.

Incidentally, when a dielectric layer is formed, in place of the resist layer, on the upper layer of the magnetic material layer 5 on the occasion of forming through-holes in the magnetic material layer 5, it is possible to manufacture a high-impedance substrate as shown in FIG. 3.

The distance "t" between the metallic plate and the resonance circuit layer can be adjusted by controlling the thickness of the magnetic material layer 5. The distance "g" between the neighboring resonance circuits of the resonance circuit layer can be adjusted by controlling the mask pattern used in photolithography. Further, the distance "h" between the magnetic material layer and the resonance circuit layer can be adjusted by controlling the thickness of the resist layer to be deposited on the magnetic material layer 5 when forming the through-holes.

The distance "t" between the metallic plate and the resonance circuit layer, the distance "g" between the neighboring resonance circuits of the resonance circuit layer, and the distance "h" between the magnetic material layer and the resonance circuit layer are respectively selected so as to satisfy the conditions of: 0.1 mm≦t≦10 mm, 0.01 mm≦g≦5 mm and the range represented by the following inequality 1, thus making it possible to manufacture the high-impedance substrate of this embodiment.

$$g/2 \leqq h \leqq t/2 \qquad \text{inequality 1.}$$

Figure 8:
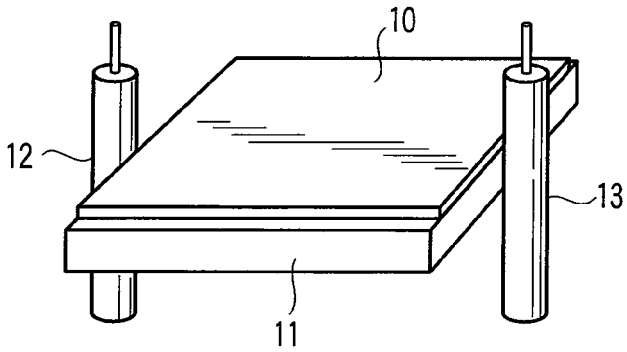
FIG. 8 is a diagram schematically illustrating one example of the high-frequency characteristics assessment system for a high-impedance substrate.
Figure 9:
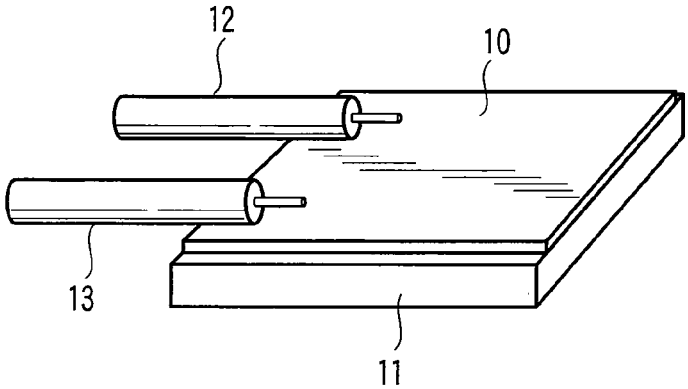
FIG. 9 is a diagram schematically illustrating another example of the high-frequency characteristics assessment system for a high-impedance substrate.

The high-frequency characteristics of the high-impedance substrate can be evaluated using the devices as shown in FIGS. 8 and 9. As shown in FIGS. 8 and 9, a wave absorber 11 is disposed below a high-impedance substrate 10 and two co-axial probes, 12 and 13, are disposed. These two co-axial probes, 12 and 13, are respectively connected with the input/output terminals of a network analyzer. In FIG. 8, the surface wave of a TM mode can be evaluated. In FIG. 9, the surface wave of a TE mode can be evaluated.

Next, examples will be explained in detail.

EXAMPLE 1

An aqueous solution of 25% tetramethyl ammonium hydroxide (TMAH) was prepared as an aqueous alkaline solution. As the aqueous acid solution, an aqueous solution containing $Co(NO_3)_2.6H_2O$ and $Mg(NO_3)_2.6H_2O$ which were regulated in composition (molar ratio) to Co:Mg=4:1 was prepared.

Then, this aqueous acid solution was added dropwise to the aforementioned aqueous alkaline solution at a rate of 3 mL/min. In this step of adding the aqueous acid solution, the pH of the resultant solution was measured to confirm that the solution was sufficiently base. After finishing the addition of the aqueous acid solution, the resultant solution was stirred for one hour and then left to stand for one hour to completely accomplish the precipitation thereof. Thereafter, the precipitated powder was taken up through vacuum filtration and dried in an air atmosphere for 12 hours at a temperature of 110° C. to obtain a powdery precursor of $(Co_{4/5}, Mg_{1/5})(OH)_2$.

The powdery precursor thus obtained was evaluated by X-ray diffraction. As a result, it was possible to observe a broad peak of a solid solution consisting of magnesium oxide and cobalt oxide, to obtain the synthesis of fine powdery low crystallinity solid solution.

This fine powdery solid solution was heated in a hydrogen gas atmosphere at a temperature of up to 800° C. to perform the reduction of the fine powdery solid solution, thus synthesizing the composite powder consisting of cobalt fine particles and magnesium oxide. Then, the composite powder was recovered in a globe box filled with an argon atmosphere. When the texture of the composite particles was observed by a transmission electron microscope, the average particle diameter of the cobalt fine particles was about 20 nm.

The composite powder consisting of cobalt and magnesium oxide and recovered as described above was kneaded together with polyvinyl butyral employed as an organic binder to prepare a slurry. This slurry was molded into a sheet, which was then pressed to manufacture a composite material sheet as a matrix medium.

It was confirmed that, in the composite material sheet thus manufactured, cobalt particles having an average diameter of 20 nm were contained in magnesium oxide at a volumetric ratio of 10%. Further, the high-frequency characteristics of the composite material were evaluated. As a result, the resonance frequency was about 10 GHz and the magnetic permeability up to 5 GHz was 1.3 at the real part (μ') thereof and not more than 0.1 at the imaginary part (μ") thereof.

Using the aforementioned composite material, a high-impedance substrate constructed as shown in FIG. 1 was manufactured. As the metallic plate, a copper foil having a thickness of about 0.1 mm was employed. Using vias formed by electrolytic plating, top copper pieces employed as a resonance circuit layer was connected to the copper foil. The aforementioned composite material was interposed between the metallic plate and the resonance circuit. In this case, the distance "t" between the metallic plate and the resonance circuit was set to 2.0 mm, and the distance "g" between neighboring resonance circuits was set to 0.15 mm. The distance "h" between the magnetic material and the resonance circuit was set to 0.2 mm. This distance "h" was confined within the range represented by the following inequality 1:

$$g/2 \leqq h \leqq t/2 \qquad \text{inequality 1.}$$

When the high-impedance substrate thus obtained was evaluated based on the assessment system shown in FIG. 8, the passing characteristic thereof was −40 dB or less at a frequency of 1.9 GHz to 2.1 GHz. Further, when the high-impedance substrate thus obtained was evaluated based on the assessment system shown in FIG. 9, the passing characteristic thereof was −40 dB or less at a frequency of 1.9 GHz to 2.1 GHz.

Based on the aforementioned results, it was confirmed that the high-impedance substrate of this example was capable of executing a high-impedance operation at a frequency of 1.9 GHz to 2.1 GHz.

EXAMPLE 2

The same kind of slurry as described in Example 1 was molded into a sheet in a magnetic field of 10 kOe and then pressed to manufacture a composite material sheet. It was confirmed that, in the composite material sheet thus manufactured, cobalt particles having an average diameter of 20 nm were contained in magnesium oxide at a volumetric ratio of 20%.

The high-frequency characteristic of the composite material thus obtained was evaluated. As a result, it was found out that the composite material exhibited anisotropy in an uniaxial direction and the resonance frequency was about 9 GHz in the easy magnetization axis direction and that a magnetic permeability up to 5.5 GHz was 1.4 at the real part (μ') thereof and not more than 0.1 at the imaginary part (μ") thereof.

Using the aforementioned composite material, a high-impedance substrate constructed as shown in FIG. 1 was manufactured. As the fundamental features, such as the material and thickness of the metallic plate, they were the same as those of Example 1. In this case however, the distance "t" between the metallic plate and the resonance circuit was set to 1.5 mm, and the distance "g" between neighboring resonance circuits was set to 0.13 mm. The distance "h" between the magnetic material and the resonance circuit was set to 0.1 mm. This distance "h" was confined within the range represented by the following inequality 1:

$$g/2 \leqq h \leqq t/2 \qquad \text{inequality 1.}$$

When the high-impedance substrate thus obtained was evaluated based on the assessment system shown in FIG. 8, the passing characteristic thereof was −40 dB or less at a frequency of 1.85 GHz to 2.15 GHz. Further, when the high-impedance substrate thus obtained was evaluated based on the assessment system shown in FIG. 9, the passing characteristic thereof was −40 dB or less at a frequency of 1.85 GHz to 2.15 GHz.

Based on the aforementioned results, it was confirmed that the high-impedance substrate of this example was capable of executing high-impedance operation at a frequency of 1.85 GHz to 2.15 GHz.

EXAMPLE 3

Using a coprecipitation method, a mixed powder consisting of magnesium oxide and cobalt oxide was synthesized and then dried. Thereafter, this mixed powder (powdery precursor) was evaluated by X-ray diffraction. As a result, it was possible to observe a broad peak of a solid solution consisting of magnesium oxide and cobalt oxide, to obtain the synthesis of a fine powdery low crystallinity solid solution.

This fine powdery solid solution was heated in a hydrogen gas atmosphere at a temperature of up to 800° C. to perform the reduction of the fine powdery solid solution, thus obtaining the composite powder consisting of cobalt fine particles and magnesium oxide. Then, the composite powder was recovered in a globe box filled with an argon atmosphere. When the texture of the composite particles was observed by a transmission electron microscope, the average particle diameter of cobalt fine particles was about 20 nm.

The composite powder consisting of cobalt and magnesium oxide and recovered as described above was kneaded together with polyvinyl butyral employed as an organic binder to prepare a slurry. This slurry was molded into a sheet, which was then pressed to manufacture a composite material sheet.

It was confirmed that, in the composite material sheet thus manufactured, cobalt particles having an average diameter of 20 nm were contained in magnesium oxide at a volumetric ratio of 30%. Further, the high-frequency characteristics of the composite material were evaluated. As a result, the resonance frequency was about 9 GHz and the magnetic permeability up to 5 GHz was 1.5 at the real part (μ') thereof and not more than 0.1 at the imaginary part (μ") thereof.

Using the aforementioned composite material, a high-impedance substrate constructed as shown in FIG. 1 was manufactured. As the fundamental features such as the material and thickness of the metallic plate, they were the same as those of Example 1. In this case however, the distance "t" between the metallic plate and the resonance circuit was set to 1.1 mm, and the distance "g" between neighboring resonance circuits was set to 0.13 mm. The distance "h" between the magnetic material and the resonance circuit was set to 0.1 mm. This distance "h" was confined within the range represented by the following inequality 1:

$$g/2 \leqq h \leqq t/2 \qquad \text{inequality 1.}$$

When the high-impedance substrate thus obtained was evaluated based on the assessment system shown in FIG. 8, the passing characteristics thereof was −40 dB or less at a frequency of 1.8 GHz to 2.2 GHz. Further, when the high-impedance substrate thus obtained was evaluated based on the assessment system shown in FIG. 9, the passing characteristics thereof was −40 dB or less at a frequency of 1.8 GHz to 2.2 GHz.

Based on the aforementioned results, it was confirmed that the high-impedance substrate of this example was capable of executing high-impedance operation at a frequency of 1.8 GHz to 2.2 GHz.

EXAMPLE 4

Core-shell type particles formed of Co particles having an average particle diameter of 20 nm and covered with an $SiO_2$ layer having an average thickness of 2 nm were prepared as a precursor. This precursor was molded into a sheet while heating and densifying it and giving anisotropy to it in a magnetic field of 10 kOe, thus manufacturing a composite material sheet. It was confirmed that, in the composite material sheet thus manufactured, cobalt particles were contained in $SiO_2$ at a volumetric ratio of 30%. Further, the high-frequency characteristics of the composite material were evaluated. As a result, the resonance frequency was about 7 GHz and the magnetic permeability was 5 at the real part (μ') thereof and not more than 0.3 at the imaginary part (μ") thereof.

Using the aforementioned composite material, a high-impedance substrate constructed as shown in FIG. 1 was manufactured. As the fundamental features such as the material and thickness of the metallic plate, they were the same as those of Example 1. In this case however, the distance "t" between the metallic plate and the resonance circuit was set to 1.1 mm, and the distance "g" between neighboring resonance circuits was set to 0.15 mm. The distance "h" between the magnetic material and the resonance circuit was set to 0.1 mm. This distance "h" was confined within the range represented by the following inequality 1:

$$g/2 \leqq h \leqq t/2 \qquad \text{inequality 1.}$$

When the high-impedance substrate thus obtained was evaluated based on the assessment system shown in FIG. 8, the passing characteristic thereof was −45 dB or less at a frequency of 1.8 GHz to 2.2 GHz. Further, when the high-impedance substrate thus obtained was evaluated based on the assessment system shown in FIG. 9, the passing characteristic thereof was −45 dB or less at a frequency of 1.8 GHz to 2.2 GHz.

Based on the aforementioned results, it was confirmed that the high-impedance substrate of this example was capable of executing high-impedance operation at a frequency of 1.8 GHz to 2.2 GHz.

EXAMPLE 5

Core-shell type particles formed of Co particles having an average particle diameter of 20 nm and covered with an $SiO_2$ layer having an average thickness of 2 nm were prepared as a precursor. This precursor was molded into a sheet while heating and densifying the precursor and giving anisotropy to the precursor in a magnetic field of 10 kOe, thus manufacturing a composite material sheet. It was confirmed that, in the composite material sheet thus manufactured, cobalt particles were contained in $SiO_2$ at a volumetric ratio of 30%.

Further, the high-frequency characteristic of the composite material was evaluated. As a result, the resonance frequency was about 7 GHz and the magnetic permeability was 5 at the real part (μ') thereof and not more than 0.3 at the imaginary part (μ") thereof.

Using the aforementioned composite material, a high-impedance substrate constructed as shown in FIG. 6 was manufactured. As the fundamental features such as the material and thickness of the metallic plate, they were the same as those of Example 1. In this case however, a dielectric layer 6 was interposed between the magnetic material layer 5 and the connecting component 4. The structure shown in FIG. 6 is taken notice of a couple of specific resonance circuits and the dielectric layer 6 was mounted on all of the neighboring resonance circuits in the same manner. Although $SiO_2$ was disposed at a thickness of 0.1 mm in this dielectric layer 6, it is possible to employ other kinds of dielectric so long as they are small in dielectric constant and low in dielectric loss.

The distance "t" between the metallic plate and the resonance circuit was set to 1.2 mm, and the distance "g" between neighboring resonance circuits was set to 0.15 mm. The distance "h" between the magnetic material and the resonance circuit was set to 0.1 mm. This distance "h" was confined within the range represented by the following inequality 1:

$$g/2 \leqq h \leqq t/2 \qquad \text{inequality 1.}$$

When the high-impedance substrate thus obtained was evaluated based on the assessment system shown in FIG. 8, the passing characteristic thereof was −45 dB or less at a frequency of 1.8 GHz to 2.2 GHz. Further, when the high-impedance substrate thus obtained was evaluated based on the assessment system shown in FIG. 9, the passing characteristic thereof was −45 dB or less at a frequency of 1.8 GHz to 2.2 GHz.

Based on the aforementioned results, it was confirmed that the high-impedance substrate of this example was capable of executing high-impedance operation at a frequency of 1.8 GHz to 2.2 GHz.

EXAMPLE 6

A high-impedance substrate was manufactured in the same manner as described in Example 5 except that a dielectric layer 6 was further interposed between the magnetic material layer 5 and the resonance circuits 2 and 3 as shown in FIG. 7.

The distance "t" between the metallic plate and the resonance circuit was set to 1.3 mm, and the distance "g" between neighboring resonance circuits was set to 0.15 mm. The distance "h" between the magnetic material and the resonance circuit was set to 0.08 mm. This distance "h" was confined within the range represented by the following inequality 1:

$$g/2 \leqq h \leqq t/2 \qquad \text{inequality 1.}$$

When the high-impedance substrate thus obtained was evaluated based on the assessment system shown in FIG. 8, the passing characteristic thereof was −45 dB or less at a frequency of 1.8 GHz to 2.2 GHz. Further, when the high-impedance substrate thus obtained was evaluated based on the assessment system shown in FIG. 9, the passing characteristic thereof was −45 dB or less at a frequency of 1.8 GHz to 2.2 GHz.

Based on the aforementioned results, it was confirmed that the high-impedance substrate of this example was capable of executing high-impedance operation at a frequency of 1.8 GHz to 2.2 GHz.

COMPARATIVE EXAMPLE 1

In the same manner as described in Example 4, core-shell type particles formed of Co particles having an average particle diameter of 20 nm and covered with an $SiO_2$ layer having an average thickness of 2 nm were prepared as a precursor. This precursor was molded into a sheet while heating and densifying the precursor and giving anisotropy to the precursor in a magnetic field of 10 kOe, thus manufacturing a composite material sheet. It was confirmed that, in the composite material sheet thus manufactured, cobalt particles were contained in $SiO_2$ at a volumetric ratio of 30%.

Further, the high-frequency characteristics of the composite material thus obtained was evaluated. As a result, the resonance frequency was about 7 GHz and the magnetic permeability was 5 at the real part (μ') thereof and not more than 0.3 at the imaginary part (μ") thereof.

Using the aforementioned composite material, a high-impedance substrate constructed as shown in FIG. 1 was manufactured. As the fundamental features such as the material and thickness of the metallic plate, they however, the distance "t" between the metallic plate and the resonance circuit was set to 1.1 mm, and the distance "g" between neighboring resonance circuits was set to 0.15 mm. The distance "h" between the magnetic material and the resonance circuit was set to 0.05 mm. Since this distance "h" was smaller than g/2, it fell out of the range represented by the following inequality 1:

$$g/2 \leqq h \leqq t/2 \qquad \text{inequality 1.}$$

When the high-impedance substrate thus obtained was evaluated based on the assessment system shown in FIG. 8, the passing characteristics thereof was −45 dB or less at a frequency of 1.97 GHz to 2.03 GHz. Further, when the high-impedance substrate thus obtained was evaluated based on the assessment system shown in FIG. 9, the passing characteristics thereof was −45 dB or less at a frequency of 1.97 GHz to 2.03 GHz. Namely, it was impossible to secure a broad band as obtained in Example 4.

COMPARATIVE EXAMPLE 2

A high-impedance substrate was manufactured in the same manner except that the distance "t" between the metallic plate and the resonance circuit was set to 1.1 mm, and the distance "g" between neighboring resonance circuits was set to 0.15 mm. The distance "h" between the magnetic material and the resonance circuit was set to 0.5 mm. Since this distance "h" was larger than t/2, it fell out of the range represented by the following inequality 1:

$$g/2 \leqq h \leqq t/2 \qquad \text{inequality 1.}$$

When the substrate was evaluated based on both of aforementioned assessment systems shown in FIGS. 8 and 9, it was impossible to obtain high-impedance characteristics at a 2 GHz band.

As explained above, by regulating the distance between the magnetic material layer and the resonance circuit layer to a predetermined range, it is possible to obtain a thin high-impedance substrate which is capable of exhibiting a large normalized bandwidth at a low frequency band and can be mounted on electronic devices.

According to the embodiment of the present invention, it is possible to provide a thin high-impedance substrate which is capable of exhibiting a large normalized bandwidth at a low frequency band and capable of being mounted on electronic devices.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A high-impedance substrate comprising:

a metallic plate to be employed as a ground plane;

a resonance circuit layer spaced away from the metallic plate by a distance "t" ranging from 0.1 to 10 mm, the resonance circuit layer being provided with at least two resonance circuits having the same height and disposed side by side with a distance "g" ranging from 0.01 to 5 mm;

a connecting component connecting the resonance circuit with the metallic plate; and a magnetic material layer interposed between the metallic plate and the resonance circuit layer and spaced away from the resonance circuit layer by a distance "h" confined within the range represented by the following inequality 1:

$$g/2 \leqq h \leqq t/2 \qquad \text{inequality 1.}$$

2. The substrate according to claim 1, wherein the magnetic material layer is formed of a nano-composite material containing magnetic particles and an insulating material.

3. The substrate according to claim 2, wherein the magnetic particles are contained in the magnetic material layer at a volume percentage ranging from 10% to 30%.

4. The substrate according to claim 2, wherein the magnetic particles are selected from the group consisting of Fe particles, Co particles, Fe—Co alloy particles, Fe—Co—Ni alloy particles, Fe-based alloy particles and Co-based alloy particles.

5. The substrate according to claim 2, wherein the magnetic particles have respectively a particle diameter ranging from 1 nm to 1000 nm.

6. The substrate according to claim 2, wherein the insulating material is selected from the group consisting of Mg oxide, Al oxide and Si oxide.

7. The substrate according to claim 2, wherein the insulating material is selected from the group consisting of polyvinyl alcohol, polybutadiene, polystyrene, polyethylene, polyethylene terephthalate, polypropylene and epoxy resin.

8. The substrate according to claim 1, further comprising a dielectric layer interposed between the magnetic material layer and the resonance circuit layer.

9. The substrate according to claim 1, further comprising a dielectric layer interposed between the magnetic material layer and the connecting component.

10. The substrate according to claim 1, further comprising a dielectric layer interposed between the magnetic material layer and the metallic plate.

11. A high-impedance substrate comprising:

a metallic plate to be employed as a ground plane;

a resonance circuit layer spaced away from the metallic plate by a distance "t" ranging from 0.1 to 10 mm, the resonance circuit layer being provided with at least two resonance circuits disposed side by side with a distance "g" ranging from 0.01 to 5 mm;

a connecting component connecting the resonance circuit with the metallic plate; and a magnetic material layer formed of a nano-composite material containing magnetic particles and an insulating material and interposed between the metallic plate and the resonance circuit layer and spaced away from the resonance circuit layer by a distance "h" confined within the range represented by the following inequality 1:

$$g/2 \leqq h \leqq t/2 \qquad \text{inequality 1.}$$

12. The substrate according to claim 11, wherein the at least two resonance circuits are disposed at the same height.

13. The substrate according to claim 11, wherein the magnetic particles are contained in the magnetic material layer at a volume percentage ranging from 10% to 30%.

14. The substrate according to claim 11, wherein the magnetic particles are selected from the group consisting of Fe particles, Co particles, Fe—Co alloy particles, Fe—Co—Ni alloy particles, Fe-based alloy particles and Co-based alloy particles.

15. The substrate according to claim 11, wherein the magnetic particles have respectively a particle diameter ranging from 1 nm to 1000 nm.

16. A high-impedance substrate comprising:

a metallic plate to be employed as a ground plane;

a resonance circuit layer spaced away from the metallic plate by a distance "t" ranging from 0.1 to 10 mm, the resonance circuit layer being provided with at least two resonance circuits having the same height and disposed side by side with a distance "g" ranging from 0.01 to 5 mm; and a magnetic material layer formed of a nano-composite material containing magnetic particles and an insulating material and interposed between the metallic plate and the resonance circuit layer and spaced away from the resonance circuit layer by a distance "h" confined within the range represented by the following inequality 1:

$$g/2 \leq h \leq t/2 \qquad \text{inequality 1.}$$

17. The substrate according to claim 16, further comprising a connecting component connecting the resonance circuit layer with the metallic plate.

18. The substrate according to claim 16, wherein the magnetic material layer is formed of a nano-composite material containing magnetic particles and an insulating material.

19. The substrate according to claim 16, wherein the magnetic particles are contained in the magnetic material layer at a volume percentage ranging from 10% to 30%.

20. The substrate according to claim 16, wherein the magnetic particles are selected from the group consisting of Fe particles, Co particles, Fe—Co alloy particles, Fe—Co—Ni alloy particles, Fe-based alloy particles and Co-based alloy particles.

* * * * *